US006055701A

United States Patent [19]

Grey et al.

[11] Patent Number: 6,055,701

[45] Date of Patent: May 2, 2000

[54] LIQUID PICK-UP APPLIANCES FOR USE IN SURFACE CLEANING OR DRYING

[75] Inventors: Nicholas Gerald Grey, Worcester; Norman Brown, Hinckley, both of United Kingdom

[73] Assignee: Vax Limited, Worcestershire, United Kingdom

[21] Appl. No.: 09/011,655

[22] PCT Filed: Aug. 13, 1996

[86] PCT No.: PCT/GB96/01970

§ 371 Date: Feb. 13, 1998

§ 102(e) Date: Feb. 13, 1998

[87] PCT Pub. No.: WO97/06721

PCT Pub. Date: Feb. 27, 1998

[30] Foreign Application Priority Data

Aug. 15, 1995 [GB] United Kingdom ..... 9516689

[51] Int. Cl.[7] ..... A47L 9/18

[52] U.S. Cl. ..... 15/327.7; 15/352; 15/353; 55/319; 55/332

[58] Field of Search ..... 15/327.7, 347, 15/352, 353; 55/319, 332

[56] References Cited

U.S. PATENT DOCUMENTS

| | | | |
|---|---|---|---|
| 1,759,947 | 5/1930 | Lee | 15/353 X |
| 2,093,748 | 9/1937 | Becker | 15/353 |
| 2,664,965 | 1/1954 | Swann | 15/347 X |
| 3,524,211 | 8/1970 | Wolf | 15/352 X |
| 4,053,293 | 10/1977 | Combs | 55/319 X |
| 4,055,405 | 10/1977 | Thun-Hohenstein | 55/319 X |
| 4,393,538 | 7/1983 | Olson | 15/353 X |
| 4,463,474 | 8/1984 | Jacobs | 15/353 |
| 4,749,387 | 6/1988 | Lotz | 55/319 X |

*Primary Examiner*—Chris K. Moore

*Attorney, Agent, or Firm*—Venable; George H. Spencer; Allen Wood

[57] ABSTRACT

An appliance for using suction to pick up liquid includes a collection container (10) with an air/liquid separator (30) arranged at a corner between two adjacent walls (13, 14) of the container and extending obliquely relative to both side walls. The separator (30) includes an inlet tube (31) which terminates in an outwardly widening outlet end portion (33) which discharges directly into the collection container (10). The inlet tube (31) and end portion (33) extend into the container (10) through an air outlet chamber (20) which is connected at an outlet opening (17) of the container (10). A filter element (40) is provided at the mouth (24) of the outlet chamber (20) and around the outlet end portion (33) of the inlet tube (31). The oblique arrangement of the separator (30) enables the appliance to be used in a vertical or horizontal orientation and the shape of the air/water separator ensures efficient separation of entrained water droplets from the air stream flowing around the rim (35) of the end portion (33) without requiring the air stream to impact on a baffle.

25 Claims, 1 Drawing Sheet

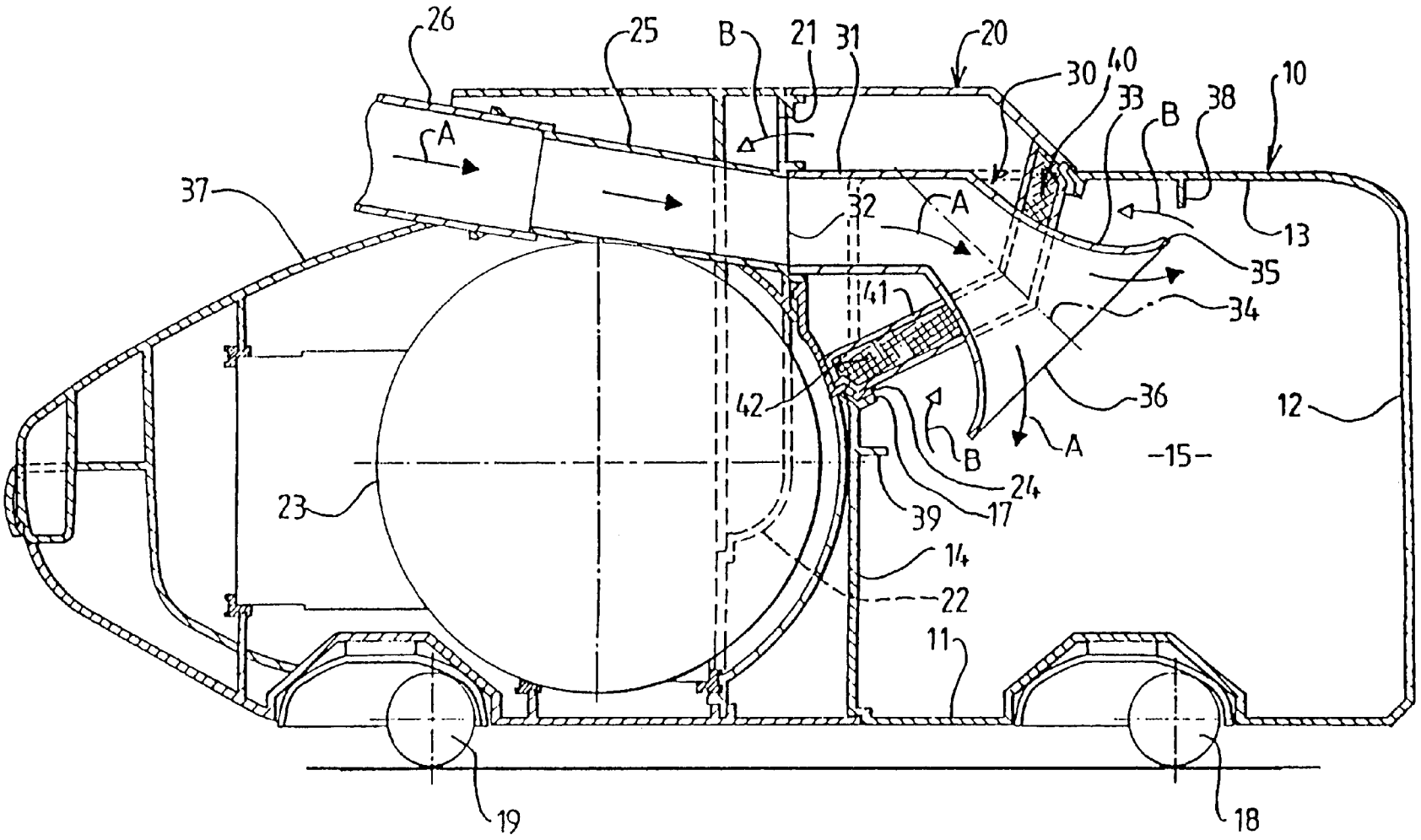
10
13
12
38
35
34
B
33
40
30
36
A
20
24
17
B
A
39
14
22
11
31
32
141
21
42
B
25
26
A
23
37
18
19
-15-

LIQUID PICK-UP APPLIANCES FOR USE IN SURFACE CLEANING OR DRYING

BACKGROUND OF THE INVENTION

This invention relates to liquid pick-up appliances for use in surface cleaning or drying operations wherein liquid is picked-up for example from a floor surface (afforded by a floor or floor covering) or other surface such as afforded by a wall or window by a suction head so as to be entrained in air flow from such head to an air/liquid separator in which entrained liquid is separated from the air flow and collected in a container.

Such an appliance may be designed and used for drying floor surfaces or picking up spillages, or it may also incorporate a reservoir for a cleaning liquid (which may be water or a suitable cleaning solution) and means for delivering such liquid to a cleaning head, which may be incorporated in, or separate from, the suction head, so that the appliance is capable of carrying out, simultaneously or sequentially, floor cleaning and floor drying operations or similar operations on other surfaces.

Various types of air/liquid separator have been proposed to enable the liquid to be separated from the air flow and delivered to a collection container. For example British Patent specification 1121225 shows a simple centrifugal separator in which the air flow enters an annular chamber tangentially, the lower side of the chamber being connected to the upper end of a collection container. Our British Patent specification 1601456 shows a separator in which the air flow is radially directed into a radially narrow annular space between the outer wall of a reservoir container and the outer wall of a collection chamber within which the reservoir container is nested, the latter having a central suction duct extending through it, and which at its lower end is formed as a downwardly widening cone with vertical vanes to prevent circular air flow.

In other examples, labyrinthine separators are employed, as shown in U.S. Pat. No. 2,986,764. In the case of relatively small hand-held devices which in use may be subjected to quite vigourous motion, elaborate arrangements are often employed within the collection container to prevent entrained droplets from being drawn out of the container, as for example in EP 0170720.

In still other cases a widening inlet tube delivers the air/liquid stream onto baffle arranged across the mouth of the tube, as for example, in German Patent specification 3540956 or U.S. Pat. No. 1,328,339.

In such prior arrangements, the air outlet from the collection chamber is located at a position remote from the air/liquid inlet.

SUMMARY OF THE INVENTION

It is an object of the present invention to provide an improved form of separator/collector of simplified but highly efficient design, It is a further object of the invention to provide a collection container which can function equally well in different orientations.

According to one aspect of the invention an appliance for picking up liquid including as suction head which entrains the liquid in an air flow from said head to an air/liquid separator and a collection container for receiving liquid from said separator, the air/liquid separator comprising an inlet tube extending from an air/water inlet and terminating in an outwardly widening outlet end portion and the collection container having an air outlet chamber through which said inlet tube extends, characterised in that said outlet end portion oft he air/liquid separator discharges directly into the collection container.

We have discovered, surprisingly, that by the simple expedient of widening the outlet end portion of the inlet tube and arranging the inlet tube to extend through the air outlet, so that the direction of air-flow is reversed in the collection container, it is possible to achieve effective separation of entrained water droplets from the incoming air flow simple as a result of the consequent decrease in air velocity and change in direction of air flow, without requiring the droplets to impact on a collection surface and without requiring violent changes in the direction of air flow, in contrast to the basic principles of previous air/liquid separators employed in such appliances.

Preferably, the end portion of the inlet tube is formed as a bell which widens progressively and smoothly from the inlet tube to an outlet opening having an area at least twice that of the cross-sectional area of the tube. In particular, the tube and outlet opening are conveniently of circular shape in transverse cross-section, and the diameter of the outlet opening is at least approximately twice that of the tube.

The internal surface of such bell is preferably of outwardly curving form and terminates in a rim portion which extends substantially transversely relative to the axial centre line of the bell. The shape of the bell may be defined as the surface of revolution swept by a curve at least approximating to part of a hyperbola, parabola or ellipse.

Between the air outlet chamber and the collection container, a filter element may be provided in the space between the inlet tube and the outer walls of the container. The filter element may be formed as a porous member of relatively large pore size (typically in the range 1 to 2.5 mm) so as not to impose a significant restriction on the air flow to the outlet, whilst affording a large surface area on which any residual entrained droplets of water can coalesce and drain towards the interior of the collection container against the outgoing air flow. Suitable material from which such filter may be constructed is a reticulated foam or a filamentary mesh, preferably made of a synthetic plastics material.

Conveniently, the surface of the filter element facing the collection container is arranged at such an angle relative to the adjacent wall of the container that, in the intended in-use orientation of the container, liquid which percolates back through the filter element can drain gravitationally towards said adjacent wall.

In a particularly preferred arrangement, the filter element extends obliquely across a corner of the collection container as defined by two adjacent walls thereof, so that the axial centre line of the bell is arranged at a substantially equal angle relative to the two adjacent walls.

With such an arrangement, the collection contain can be disposed in a range of orientations without impairing the efficiency of the separator.

In particular, this enables the collection container to be housed in, or form part of, a suction cleaner of the canister type which can be used in either horizontal or vertical orientations.

Thus, the collection container can be associated with an impeller and motor assembly which creates the required air flow in a free-standing unit which, when orientated horizontally, can rest on the floor surface being cleaned and be pulled across such surface and which in the vertical orientation can stand in a stable manner for example on one tread of a flight of stairs which are being cleaned.

In accordance with a further aspect of the invention, we provide a collection container for use with an appliance for picking up liquid by means of a suction head which entrains the liquid in an air flow from said head to said collection container, wherein the collection container comprises an air/liquid separator and a hollow body for receiving liquid from said separator, the air/liquid separator comprising an inlet tube extending from an air/water inlet and terminating in an outwardly widening outlet end portion of the air/liquid separator discharges directly into the collection container.

In accordance with another aspect of the invention we provide a collection container for use with an appliance for picking up liquid by means of a suction head which entrains the liquid in an air flow from said head to said collection container, wherein the collection container comprises an air/liquid separator and a hollow body having two adjacent wall portions which extend substantially perpendicularly to one another, characterised in that said air/liquid separator is arranged with a longitudinal centre line thereof extending from a corner defined by the junction between said adjacent side wall portions and at an oblique angle relative to both of said adjacent side wall portions, and in that said body has two further wall portions which extend substantially perpendicular to one another and meet at a corner opposite that at which said air/liquid separator is disposed, whereby said container can rest in a stable manner on either of said further wall portions respectively in a horizontal orientation on a floor surface being cleaned for movement across such surface or in a vertical orientation for example on one tread of a flight of stairs which are being cleaned.

BRIEF DESCRIPTION OF THE DRAWING

The FIGURE of the drawing shows a side cross-sectional view of a liquid collection container embodying the invention.

DESCRIPTION OF THE PREFERRED EMBODIMENT

The invention will now be described by way of example with reference to one embodiment of appliance incorporating a liquid collection container with an air/liquid separator in accordance with the invention, as illustrated in the accompanying drawing.

In the accompanying drawing a container 10 for the collection of water or other liquid picked up by means of a suction head (not shown) in a floor cleaning or drying operation comprises a hollow body in the form of a tank of generally rectangular cross-section and bounded by a bottom wall 11, rear wall 12, top wall 13, front wall 14 and side walls 15.

An obliquely arranged outlet opening 17 is provided at a corner of the container 10 at the junction of the top and front walls 13,14.

An outlet chamber 20 is connected to the container 10 at the opening 17. The outlet chamber 20 is formed with an air outlet opening 21 which communicates with an air duct 22 leading to the inlet of a motor-driven impeller 23. Opposite the air outlet opening 21 the outlet chamber affords a mouth 24 communicating with the interior of the container 10.

An air/water separator 30 extends through the outlet chamber 20 to the interior of the container 10.

The separator 30 comprises an inlet tube 31 having an inlet opening 32 at one end adjacent to the outlet opening 21 and terminating at the other end in an outwardly widening bell 33 which extends at an oblique angle relative to the tube 31 and extends into the container 10 on a centre line 34 arranged at an angle of approximately 45° to the top and front walls 13,14. The bell 33 terminates in a rim 35 which extends substantially perpendicular relative to the axis 34 and defines an outlet end 36 having a diameter approximately twice that of the inlet tube 31. As can seen, the side walls of the bell 33 curve smoothly outwardly to merge with the rim 35, and preferably the bell is defined as a surface of revolution swept by a curve at least approximating to part of a hyperbola, parabola or ellipse.

An annular filter element 40 is arranged at the mouth 24 of the outlet chamber 20 and surrounding the bell 33. The filter element 40 comprises an apertured casing 41, which serves to locate the bell 33 within the mouth 24 of the chamber 20, and a porous filter member 42 of relatively large pore-size, typically in the range 1 to 2.5 mm, so as not to impose a significant restriction on the air flow to the outlet 21, whilst affording a large surface area on which any residual entrained droplets of water can coalesce.

The inlet opening 32 of the tube 31 registers with one end of a suction tube 25 which is connectable at its other end to a suction hose 26 leading to any suitable form of pick-up head (not illustrated). Suction is applied to the pick-up head by means of the motor-driven impeller 23 which is located forwardly of the container 10 within a casing 37, and which draws air through the container 10 as indicated by the arrows A/B. Air is thus drawn through the pick-up head, suction hose 26, suction tube 25, inlet tube 31 and bell 33 into the interior of the container 10, around the rim 35 of the bell 33, through the filter member 42 into the outlet chamber 20 to the outlet opening 21 of the air duct 22 and into the impeller 23.

Liquid which is entrained in the incoming air flow as indicated by arrows A is separated from the air as a result of the reduction in the speed of the air flow which occurs in the bell 33 which widens smoothly in the downstream direction, and the reversal of direction around the rim 35. Any residual droplets which remain entrained in the air flow are caught in the filter member 42 and drain gravitationally towards the bottom of the filter element 40 and the front wall 14 of the container 10. the air flow downstream of the filter member 42, as indicated by arrows B, being substantially free of entrained liquid.

If necessary, the outlet chamber 20 may be so dimensioned as to constitute an expansion chamber in which the rate of air flow is further reduced so that any droplets which may pass through the filter element 40 can separate out before the air reaches the outlet opening 21.

In practice, water may be collected in the container 10 until it reaches a level approaching, or even slightly exceeding, the lower edge of the bell 33, without impairment in the efficiency of water separation, the air flow around the lowermost part of the bell 33 causing a local depression in the surface of the collected liquid.

Ribs 38,39 provided on the top and front walls 13,14 serve as barriers to reduce the risk of collected water splashing into the mouth 24 of the outlet chamber 20 as the appliance is moved.

As illustrated, rollers 18,19 are provided at the underside of the unit comprising the assembly of casing 37 and container 10 so that the unit may rest on a floor and be pulled over the surface of the floor by means of the hose 26 whilst cleaning is in operation.

However, the rear wall 12 of the container 10 is substantially flat and is adapted to serve as an alternative base on which the unit can stand in an upright position, for example on a stair tread. Due to the angled arrangement of the bell 33, air/water separation is performed as efficiently in such alternative orientation, and the appliance can be used in either orientation without requiring any adjustment by the user.

The container 10 is designed for releasable assembly with the casing 37, so that the contents of the container 10 can be emptied by removing the container from the casing and removing the assembly, of outlet chamber 20 separator 30 and filter 40, whereby the collected liquid can be emptied through the mouth 24.

If the cleaner is also to be used as an ordinary vacuum cleaner for picking up dust and other dry material, a further, interchangeable collection container can be provided for use in place of the collection container 10, such further collection container incorporating a filter or the like for removing dust from the air flow.

The apparatus may also include a reservoir for a cleaning liquid which is to be applied to the surface to the cleaned by means of a suction head or a separate liquid applicator head.

The features disclosed in the foregoing description, or the accompanying drawing, expressed in their specific forms or in terms of a means for performing the disclosed function, or a method or process for attaining the disclosed result, may, separately or in any combination of such features, be utilised for realising the invention in diverse forms thereof.

What is claimed is:

1. An appliance for picking up liquid including a collection container having an air outlet chamber, an air/liquid separator extending through said outlet chamber and having an air/water inlet and an outlet opening, and a suction head which entrains liquid in an air flow from said suction head to said air/liquid separator, the air/liquid separator comprising an inlet tube which extends from said air/water inlet and terminates in an outwardly widening outlet end portion leading to said outlet opening, said outlet opening discharging directly into the collection container.

2. An appliance according to claim 1 wherein said outlet end portion of the inlet tube is formed as a bell which widens progressively and smoothly to said outlet opening and said outlet opening has an area at least twice that of the cross-sectional area of said air/water inlet.

3. An appliance according to claim 2 wherein said inlet tube and outlet opening are of circular shape in transverse cross-section, and the diameter of the outlet opening is approximately twice that of said air/water inlet.

4. An appliance according to claim 3 wherein the internal surface of said bell is of outwardly curving form and terminates in a rim portion which extends substantially transversely relative to the axial centre line of the bell.

5. An appliance according to claim 4 wherein the shape of the bell is defined as the surface of revolution swept by a curve at least approximating to part of a hyperbola, parabola or ellipse.

6. An appliance according to claim 1 wherein said air/water inlet is disposed at a corner of the collection container at the junction of two adjacent walls thereof, said outlet end portion of said inlet tube having a centre line which is inclined relative to both of said walls.

7. An appliance according to claim 6 wherein said centre line of said outlet end portion is inclined at a substantially equal angle to both of said walls.

8. An appliance according to claim 1 wherein a filter element is provided within said air outlet chamber.

9. An appliance according to claim 8 wherein the filter element is formed as a porous member of pore size in the range 1 to 2.5 mm so as not to impose a significant restriction on the air flow to the outlet, whilst affording a large surface area on which any residual entrained droplets of water can coalesce and drain towards the interior of the collection container against the outgoing air flow.

10. An appliance according to claim 8 wherein said filter element extends generally at an oblique angle relative to a side wall of said container that is adjacent to said outlet chamber, such that, in the intended in-use orientation of the container, liquid which percolates back through the filter element drains gravitationally towards said adjacent wall.

11. An appliance according to claim 10 wherein said air outlet chamber is disposed at a corner of the collection container which is also adjacent to said outlet chamber, and said filter element extends obliquely across said corner, said outlet end portion of said inlet tube having an axial centre line arranged at a substantially equal angle relative to said walls adjacent to said air outlet chamber.

12. An appliance according to claim 11 wherein an impeller and motor assembly which creates the required air flow is disposed next to one of said adjacent walls so that said assembly and said collection chamber form a unit which, when orientated horizontally with said assembly disposed alongside said collection container, can rest on a floor surface being cleaned and be pulled across such surface and which, when in a vertical orientation with said assembly disposed above said collection container, can stand upright in a stable manner.

13. A collection container for use with an appliance for picking up liquid by means of a suction head which entrains the liquid in an air flow from said head to said collection container, wherein the collection container comprises a hollow body having an air outlet chamber, and an air/liquid separator extending through said outlet chamber and having a first end with an air/water inlet and a second end with an outlet opening discharging directly into the interior of the container, and the aid/liquid separator comprises an inlet tube which extends from said air/water inlet and terminates in an outwardly widening outlet end portion leading to said outlet opening.

14. A collection container according to claim 13 wherein said end portion of the inlet tube is formed as a bell which widens progressively and smoothly to an outlet opening and said outlet opening has an area at least twice that of the cross-section area of said air/water inlet.

15. A collection container according to claim 14 wherein the inlet tube and said outlet opening are of circular shape in transverse cross-section, and the diameter of said outlet opening is approximately twice that of said air/water inlet.

16. A collection container according to claim 15 wherein the internal surface of said bell is of outwardly curving form and terminates in a rim portion which extends substantially transversely relative to the axial centre line of the bell.

17. A collection chamber according to claim 16 wherein the shape of the bell is defined as the surface of revolution swept by a curve at least approximating to part of a hyperbola, parabola or ellipse.

18. A collection container according to claim 13 wherein said air/water inlet is disposed at a corner of the collection container at the junction of two adjacent walls thereof, said outlet end portion of said inlet tube having a centre line which is inclined relative to both of said walls.

19. A collection container according to claim 18 wherein said centre line of said outlet end portion is inclined at a substantially equal angle to both of said side walls.

20. A collection container according to claim 13 wherein a filter element is provided within said air outlet chamber and surrounding said inlet tube.

21. A collection container according to claim 20 wherein the filter element is formed as a porous member of pore size in the range 1 to 2.5 mm so as not to impose a significant restriction on the air flow to the outlet, whilst affording a large surface area on which any residual entrained droplets of water can coalesce and drain towards the interior of the collection container against the outgoing air flow.

22. A collection container according to claim 20 wherein said filter element extends generally at an oblique angle relative to a side wall of said container that is adjacent to said outlet chamber, and a surface of the filter element facing the collection container is arranged at such an angle relative to said adjacent wall of the container that, in the intended in-use orientation of the container, liquid which percolates back through the filter element drains gravitationally towards said adjacent wall.

23. A collection container according to claim 22 wherein said air outlet chamber is disposed at a corner of the collection container which is also adjacent to said outlet chamber, and said filter element extends obliquely across said corner, said outlet end portion of said inlet tube having an axial centre line arranged at a substantially equal angle relative to said walls adjacent to said air outlet chamber.

24. A collection container according to claim 23 wherein said collection container comprises two further walls which extend substantially perpendicular to one another and meet at a corner opposite that at which said air/liquid separator is disposed, whereby said container can rest in a stable manner on either of said further walls.

25. A collection container for use with an appliance for picking up liquid by means of a suction had which entrains the liquid in an air flow from said head to said collection container, wherein the collection container comprises a hollow body having a first pair of adjacent wall portions which extend substantially perpendicularly to one another and define between them a first corner of said body, and a second pair of adjacent wall portions which extend substantially perpendicularly and define between them a second corner of said body disposed opposite to said first corner, an air/liquid separator disposed in said first corner and having an outlet arranged at an oblique angle relative to both of said first pair of adjacent wall portions, whereby said container can be used in either of two stable orientations in which it rests respectively on one or the other of said second pair of adjacent wall portions.

* * * * *